US005477988A

United States Patent [19]

Gerich

[11] Patent Number: 5,477,988

[45] Date of Patent: Dec. 26, 1995

[54] FLUID DISPENSING GUN

[76] Inventor: Horst Gerich, 17 Affonso Dr., Carson City, Nev. 89706

[21] Appl. No.: 283,351

[22] Filed: Aug. 1, 1994

[51] Int. Cl.[6] ..... B67D 5/52

[52] U.S. Cl. ..... 222/137; 137/607; 222/145.5; 222/340; 222/380; 222/509; 239/414

[58] Field of Search ..... 222/135, 137, 222/145.1, 145.5, 145.6, 340, 380, 394, 402.25, 509; 137/607; 251/322; 239/414, 415

[56] References Cited

U.S. PATENT DOCUMENTS

| | | | |
|---|---|---|---|
| 1,788,810 | 1/1931 | Tittemore | 239/415 |
| 2,786,716 | 3/1957 | Peeps | 239/415 X |
| 3,008,808 | 11/1961 | Hodges | 23/285 |
| 3,318,530 | 5/1967 | Rhodes | 239/415 X |
| 3,361,412 | 1/1968 | Cole, III | 259/4 |
| 3,390,814 | 7/1968 | Creighton, Jr. et al. | 222/137 |
| 3,741,441 | 6/1973 | Eberle | 222/135 |
| 3,989,228 | 11/1976 | Morris et al. | 259/4 |
| 4,925,101 | 5/1990 | Konieczynski et al. | 239/415 X |
| 5,127,547 | 7/1992 | Gerich | 222/55 |
| 5,375,743 | 12/1994 | Soudan | 222/145.5 |

*Primary Examiner*—Joseph A. Kaufman
*Attorney, Agent, or Firm*—Kenneth J. Hovet

[57] ABSTRACT

A fluid dispensing gun is provided which is manually operated by a lever arm and cam mechanism. As an operator draws the lever arm to an open flow position, a pivot plate displaces a cam bar to which is attached a valve stem. This causes movement of the valve stem away from a valve opening and permits fluid flow. A U-shaped stem housing and an open tubular spring housing provide convenient access for axial adjustment of the valve stem and compression adjustment of the valve spring.

20 Claims, 3 Drawing Sheets

FLUID DISPENSING GUN

BACKGROUND OF THE INVENTION

1. Field of the Invention

The present invention relates to manually operated devices that control and dispense fluids.

2. Description of Related Art

The technology of resins and polymers has evolved to where such materials can be used under extremely harsh conditions and serve as replacements for metals, wood and concrete. Additionally, new resins have been developed to function as adhesives whereby the strength of adhesion almost equals the strength a metal fastener. Such technology, however, has made it imperative that the devices which are used to meter, mix and dispense must be very reliable and exceptionally resistent to wear and corrosive chemicals.

An apparatus suitable for accomplishing the above purposes was developed by the inventor and is described in U.S. Pat. No. 5,127,547. The patented apparatus was not a hand-held device and it included heavy pumping means for metering accurate amounts of reactive materials just prior to their mixture at an end-use application. Thus, it became important to provide a fluid control and dispensing device which could be supplied with metered amounts of fluid materials from the above device while also being easily moved and manually actuated in-situ. Such devices would have extraordinary utility on manufacturing assembly lines or at construction sites.

SUMMARY OF THE INVENTION

The apparatus of the present invention provides a fluid control and dispensing device which can handle one or more fluids. The device is uniquely constructed to allow easy dismantling of the essential components for cleaning and replacement. It also enables a user to visually observe the primary workings of the device and permit quick and accurate adjustment of the various moving parts. Still further, the invention provides a device that may be hand-held with the capability of controlling high pressure fluids without the necessity of thinning solvents or other means for adulterating the desired fluid materials.

Basic elements of the invention include a valve body comprising a valve portion and a handle portion. The valve portion is defined by opposing lateral side walls with an actuator end wall and an opposing control end wall. A control duct extends through the valve portion from the actuator end wall to the opposite control end wall.

Proximate to the control end wall is a valve seat means having a valve opening that communicates with the control duct. The valve handle portion includes a feed duct which also communicates with the control duct. An external source of pressurized fluid, such as that from the inventor's aforementioned metering pump, is connected to the feed duct.

Adjacent the actuator end wall is a stem housing. The housing comprises an outer wall from which extend opposing upper and lower walls. When attached to the actuator end wall, an interior chamber is formed having lateral side openings. The housing outer wall includes a biasing adjustment opening which extends through the wall.

Located within the chamber is a cam bar having opposing ends. At least one opposing end extends beyond a respective lateral side opening to provide a cam abutment surface. A valve stem is adjustably attached to the cam bar and extends into the control duct. The valve stem has sufficient longitudinal length so that its terminal end portion engages the valve opening of the valve seat means.

To manually operate the above assembly, a pivot plate is used having a lever end and a longitudinally spaced-apart actuator end. The actuator end is pivotally connected to the valve portion and includes an offset cam portion which engages the aforementioned cam abutment surface. When the pivot plate is rotated about its pivot connection, the cam portion will axially displace the cam bar which creates a like movement of the valve stem.

FIG. **4*a*** is an enlarged isometric view of the cam bar and valve stem assembly showing the valve stem as a unitary solid structure.

DESCRIPTION OF THE PREFERRED EMBODIMENTS

Figure 1:
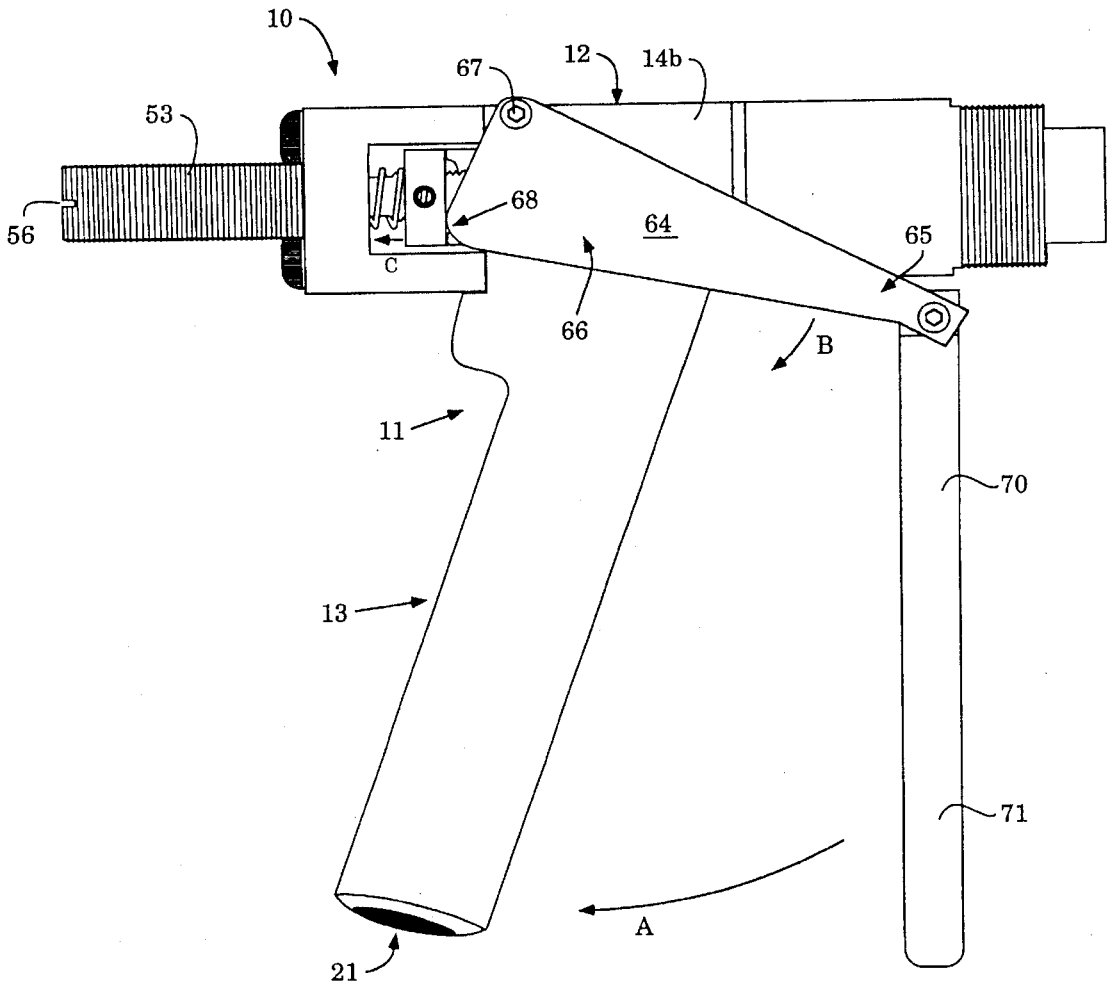
FIG. 1 is a side elevation view of the fluid control and dispensing apparatus of the invention.
Figure 2:
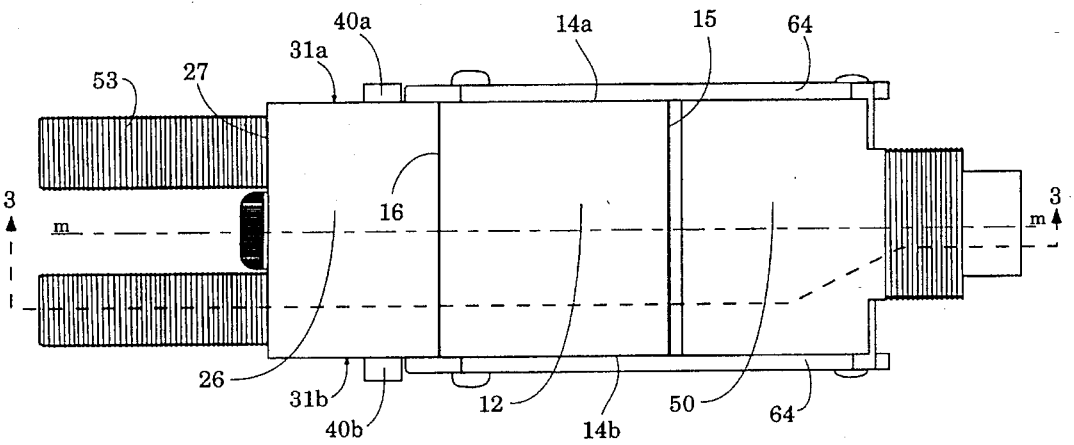
FIG. 2 is a top plan view of the apparatus of FIG. 1.
Figure 3:
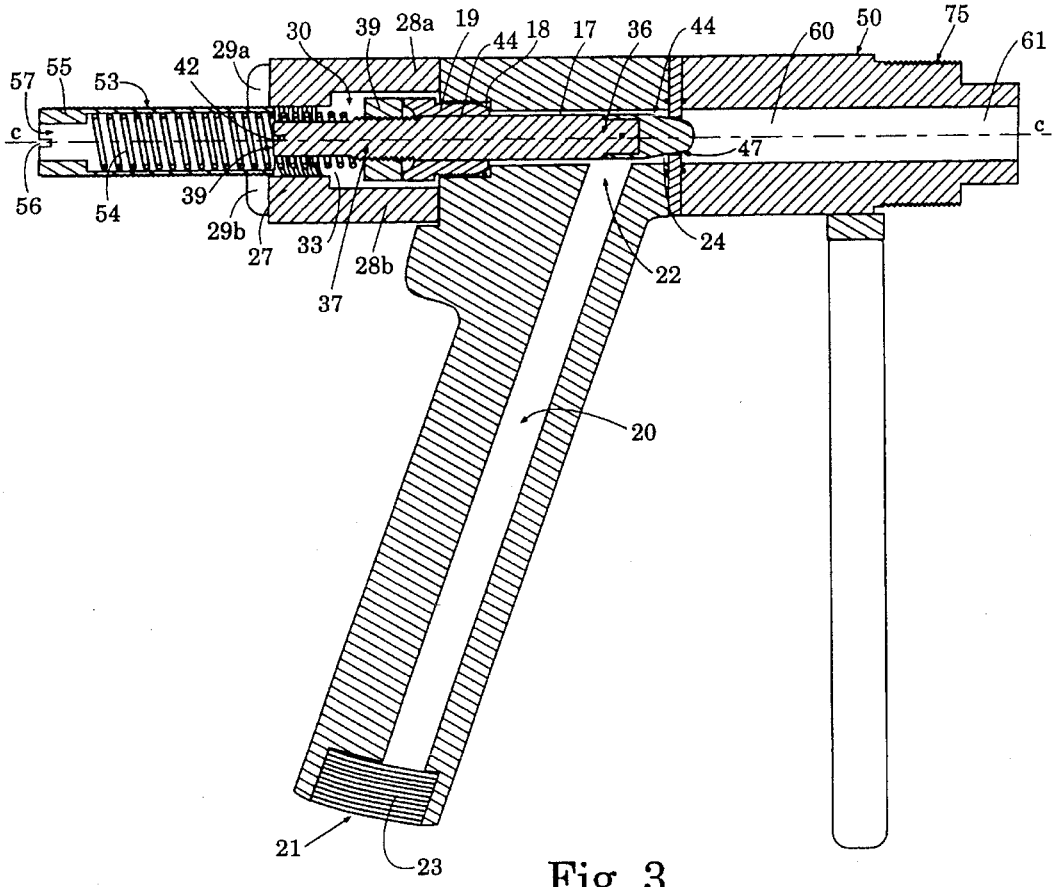
FIG. 3 is a cross-sectional view taken along line 3—3 of FIG.

With particular reference to FIGS. 1–3 of the drawings, an overall fluid control and dispensing apparatus is shown by reference number 10. The apparatus is adapted for use with liquids having a wide range of viscosities. However, the invention has particular application to the control and dispensation of fluid materials having a high viscosity which are provided in metered quantities to the apparatus at pressures exceeding 2,000 psi. In such cases, it is preferred that the apparatus be constructed of a heavy-duty stainless steel material which will not only withstand the pressures involved, but will also be resistent to any corrosive materials contained in the fluids. Additionally, the stainless steel will resist wear and may be readily dismantled and reassembled without significant disadvantage.

The basic element of the apparatus comprises a valve body 11 which includes a valve portion 12 and a downwardly extending handle portion 13. The aforementioned portions can be separate components connected together or be defined portions of an integrated whole valve body. For purposes of defining the location and relative position of additional elements, the valve portion is characterized as having opposing lateral side walls **14*a,b* extending between an actuator end wall 16 and an opposing control end wall 15**. Preferably, these walls comprise generally flat surfaces to provide stable connections with like surfaces of adjacent components.

While the drawings show dual fluid flow channels, it will be appreciated that the invention comprehends a device that can have a single flow channel. And, to facilitate describing all elements of the invention, the description hereinbelow will pertain only to a single flow channel. In fact, when the preferred apparatus shown in the drawings is divided by a median plane (line m,m of FIG. 2), mirror image bilaterally symmetrical halves are formed. Thus, unless explained otherwise, all descriptions of elements relating to a single flow channel will apply equally to both of the flow channels shown in the drawings.

Extending through the valve portion from the actuator end wall through to the control end wall is a control duct 17. The control duct has a longitudinal axis shown by lines c,c in FIG. 3. It has a generally uniform diameter except for an enlarged diameter area 18 that opens into the actuator end wall. Preferably, this area is threaded to engage corresponding threads of a valve stem bushing 19 in a manner to be hereinafter described.

Handle portion 13 comprises an elongated part which is sized to be manually grasped with one's hand. As shown, it extends at an acute angle with respect to the longitudinal axis c,c and includes a feed duct 20. The feed duct extends longitudinally throughout the length of the handle portion from an inlet 21 to an outlet opening 22 at the control duct. The inlet opening is provided with means, shown as threads 23, for connection to an external source of pressurized fluid which is not part of the present invention. It is preferred that the feed duct have a smooth uniform interior diameter and that the outlet opening 22 be located in close proximity to the outlet end 24 of the control duct 17.

Attached to valve portion 12 is stem housing 26. In the preferred embodiment, this housing has a U-shaped structure defined by an outer wall 27 and opposing upper and lower walls 28*a,b*. The upper and lower walls extend coextensively outward a predetermined distance from the end wall and abut against the actuator end wall 16. Housing fasteners 29*a,b* are used to secure the stem housing to the actuator end wall. As a result of its U-shaped structure and the given length of upper and lower walls, an open-sided interior chamber 30 is formed. The open sides of the chamber are characterized as opposing lateral side openings 31*a,b*.

Extending through the stem housing outer wall is a biasing adjustment opening 33. The center axis of this opening is coaxial with axis c,c of the control duct.

Also aligned along axis c,c is valve stem 35. The valve stem extends from at least chamber 30 through the control duct and into duct outlet 24. The stem has a generally round cross-sectional shape with a diameter somewhat less than that of the control duct to facilitate its reciprocation therein. It comprises an opposing actuator portion 37 which merges into a terminal end portion 36.

Connected to the actuator portion of the valve stem is cam bar 39. The cam bar is positioned within interior chamber 30 and has sufficient width to extend laterally outward through a respective lateral side opening beyond the plane of a respective lateral side wall. When the apparatus comprises a dual channel system, it is preferred that both ends of the cam bar be extended and utilized as cam abutment surfaces. In FIG. 2, the sections of the cam bar that extend beyond the aforesaid side walls are shown by references 40*a,b*. These sections provide cam abutment surfaces 41*a,b* for a purpose to be hereinafter described.

Various means for adjustably attaching the valve stem to the cam bar can be used such as an open slot or clamping means. When the stem is inserted through stem aperture 34, means such as set screws, lock collars and/or opposing lock nuts can be used. As shown, the preferred embodiment simply utilizes a threaded stem aperture which adjustably engages corresponding external threads along a predetermined section of the actuator portion. Longitudinal adjustment can thereby be accomplished simply by rotation of the valve stem via an implement engagement end 38. As shown in FIG. 3, the engagement end comprises a screwdriver slot 42. An allen wrench opening or socket engagement structure could also be used.

As mentioned, it is expected that the valve stem diameter will closely correspond with the diameter of control duct 17. However, depending on the type of materials being dispensed, it is oftentimes preferable to provide sealing means to ensure that leakage will not occur into the chamber area. Further, the stem has a significant longitudinal extent and supporting its mid-point is oftentimes desirable. To this end, the valve stem bushing 19 is provided which threadably engages the enlarged open area 18 of the aforementioned control duct. Although not shown, the bushing may be provided with one or more O-rings extending about its interior diameter through which the valve stem extends. Additionally, the inner end of the bushing may also include an O-ring to prevent fluid leakage through its threaded connection about opening 18.

Figure 4:
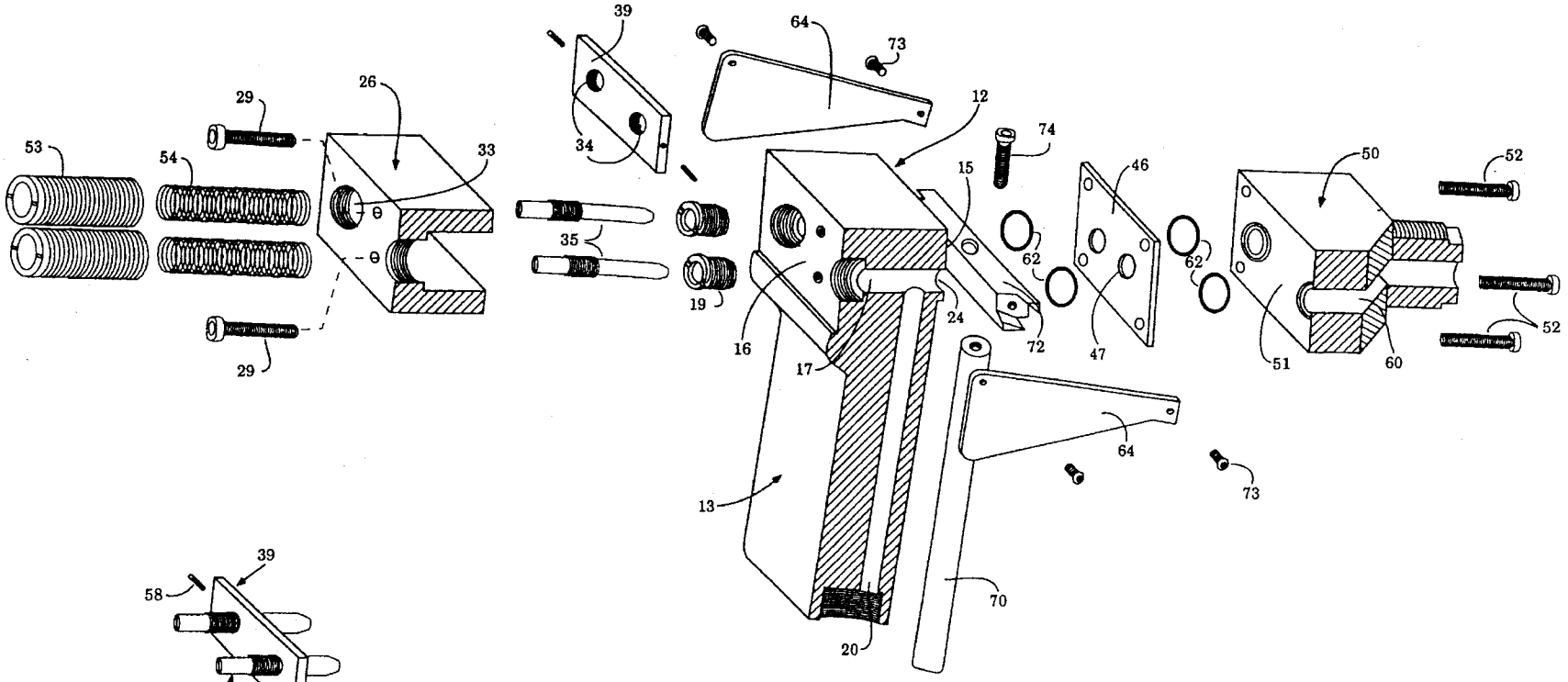
FIG. 4 is an isometric exploded view of the apparatus of FIG. 1 showing partial cross-sectional views of the stem housing, valve body and end body of the invention.

Connected to the valve portion, proximate the control end wall 15, is a valve seat means which includes a valve opening 47 in communication with the control duct. As best shown in FIG. 4, the valve seat means comprises a valve plate 46 which is sandwiched between the control end wall and face 51 of end body 50. Conventional fasteners 52 are used to secure the assembly to valve portion 12.

Figure 4A:
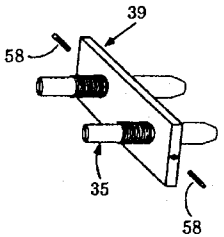

The center axis of the valve opening is aligned to be coextensive with axis c,c of the control duct. The valve stem terminal end portion may be tapered or rounded in a conventional manner to sealingly engage the valve opening when the device is in a closed position. In such case, it is expected that the valve stem will comprise one elongated solid body, as shown in FIG. 4*a*, with a carefully machined terminal end portion for engagement with a corresponding precision machined valve opening.

To ensure that a sealing engagement will always occur, even if the valve stem may become slightly misaligned, the terminal end portion may be provided with a pivoted alignment head. As best shown in FIGS. 3 and 4, this includes a hinged valve head 48 which is pivotally connected to a socket end 49.

To ensure that the overall device is always disposed in a closed non-flow position when not in use, a biasing adjustment means is provided. This means is connected to the stem housing for the purpose of continuously urging the valve stem terminal end portion into sealing engagement with the valve opening.

The biasing adjustment means comprises a spring housing having an abutment part. The housing is adjustably connected to the biasing adjustment opening 33. A spring member 54 is interposed between the abutment part and the cam bar. As best shown in FIG. 3, the spring housing comprises a tube structure having external threads for engagement with corresponding threads in the adjustment opening 33. The outer end of the tube is provided with the abutment part comprising open cap 55. The outer diameter of the spring member is less than the tube inner diameter so that the spring will extend within the tube structure and abut against the inner edges of the end cap.

To increase or decrease the amount of compression force against the cam bar and valve stem, the spring adjustment part is simply rotated about its threaded engagement to move it inwardly or outwardly as desired. To accomplish this, an adjustment slot 56 at the distal end of the cap end is provided for engagement with a screwdriver or the like.

As best shown in FIG. 4, the end cap has a central opening 57 except for the annular thickness of the cap itself. This structure and the open coil structure of the spring member, permit insertion of an implement through the interior of the spring housing for accessing slot 42 of the valve stem. As such, the valve stem can be rotated for longitudinal adjustment without dismantling the entire stem housing assembly.

It will also be appreciated that the lateral position of the valve stem can be securely fixed against inadvertent movement by the use of set screws 58. As shown in FIGS. 4 and 4*a*, these will extend through corresponding openings on opposing edges of the cam bar sections and engage the actuator portion of the valve stem. This advantage is possible because of the U-shaped stem housing structure and the relative positioning of the cam bar.

Communicating with the outlet or downstream side of valve plate 46 is an outlet duct 60. This duct extends through the body 50 to an exit duct 61. To ensure against leakage at the joints between the faces of the valve plate, control end wall and end body face, annular recesses are provided with corresponding O-rings shown by reference number 62.

To manually operate the apparatus from a normally closed disposition to an open position, a pivot plate and lever arm assembly is provided. With reference to FIG. 1, pivot plate 64 is shown having a lever end 65 and a longitudinally spaced-apart actuator end 66. The actuator end is connected to a pivot point 67 on a respective lateral side wall of the valve portion. The actuator end further includes a cam portion 68 which is offset from the pivot point a distance sufficient to engage the cam abutment surface 41.

Secured to lever end 65 of the pivot plate is lever arm 70. The lever arm extends downwardly from the pivot plate into an area proximate the handle portion 13 of the valve body. The distance between the lever arm free end and handle portion should not be greater than the distance that a user can manually grasp both the handle portion and lever arm together with one hand.

The lever arm is securely attached to the pivot plate so that drawing the free end 71 toward the handle portion, as shown by arrow A in FIG. 1, will result in a downward movement of the pivot plate as shown by arrow B. This will cause cam portion 68 to move outwardly and push against the cam bar abutment surface 41. Such action results in an axial displacement of the combined cam bar and valve stem as shown by arrow C. The axial displacement will likewise compress spring member 54. When the lever arm is released, the compressed spring member will force the cam bar back against the cam portion 68 and cause the pivot plate to rotate back upwardly to its closed at rest position.

When dispensing thick viscous fluids and/or corrosive materials, it is desirable to minimize the accumulation of such materials about the feed control area 44 of the control duct. This area is defined by the annular space surrounding the terminal end portion of the valve stem and corresponding walls of the control duct. Thus, another advantage of the invention is that outlet opening 22 is located at the above-defined feed control area. Such proximity minimizes the distance from the duct opening to the valve opening 47 and provides better control of the fluid movement and less resident time of the materials about the critical control area.

As mentioned previously, while the invention has been described with respect to one control duct, valve stem, outlet duct and related parts and openings, substantially the same descriptions apply to a dual channel apparatus. In such case, a second control duct would be provided through the valve portion and the valve seat means would include a second valve opening in communication with the second control duct. Also, the handle would include a second feed duct and a second biasing adjustment opening would extend through the stem housing outer wall. Also, a second valve stem would be attached to the cam bar and extend into the second control duct.

In the dual channel mode, the corresponding cam bars and valve stems must move precisely in unison so that the exact amounts of materials will be dispensed and ultimately combined in a downstream mixer (not shown). This, of course, is not a problem since the rigid cam bar will actuate both flow channels simultaneously. Further, when both channel systems are being used, it is preferred to use a second pivot plate assembly which will operate against an opposing cam bar extension. In this variation, the invention comprehends the addition of a tie bar 72 for interconnecting both of the opposing pivot plates. As shown in FIG. 4, the tie bar is fixedly attached to the lever end of each respective pivot plate with tie fasteners 73. The lever arm will then be connected to the mid-point of the tie bar with an arm fastener 74. Consequently, an operator will still only need to grasp a single lever arm to actuate and precisely dispense two streams of fluids with one movement of the arm.

While the invention has been described with respect to a preferred embodiment, it will be apparent to those skilled in the art that various modifications and improvements may be made without departing from the spirit and scope of the invention. Accordingly, it is to be understood that the invention is not to be limited by the specific illustrative embodiments, but only by the scope of the appended claims.

I claim:

1. A fluid control and dispensing apparatus comprising:

a valve body having a valve portion and a handle portion, said valve portion defined by opposing lateral sidewalls, an actuator end wall and an opposing control end wall;

a control duct extending through said valve portion from said actuator end wall to said control end wall;

a valve seat means connected to said valve portion proximate said control end wall, said valve seat means having a valve opening in communication with said control duct;

a feed duct in said handle portion communicating with said control duct;

a stem housing secured to said valve portion having an outer wall which is spaced apart from said actuator end wall to form an interior chamber having lateral side openings, said outer wall including a biasing adjustment opening extending therethrough;

a cam bar located within said chamber, said bar having opposing bar ends at least one of which extends beyond a respective lateral side opening to provide a cam abutment surface;

a valve stem adjustably attached to said cam bar extending into said control duct, said valve stem having a terminal end portion adapted to sealingly engage the valve opening of said valve seat means; and, a pivot plate having a lever end and a longitudinally spaced apart actuator end pivotally connected to said valve portion, said actuator end including a cam portion which engages the cam abutment surface on said cam bar to axially displace said cam bar when said pivot plate is rotated.

2. The apparatus of claim 1 including a biasing adjustment means connected to said stem housing to bias said terminal end portion against said valve opening.

3. The apparatus of claim 2 wherein said biasing adjustment means comprises a spring housing adjustably connected to said biasing adjustment opening, said spring housing having an abutment part; and, a spring member interposed between said abutment part and said cam bar.

4. The apparatus of claim 3 wherein said spring housing comprises a tube structure which is threadably attached to said biasing adjustment opening, said tube structure having an outer end wherein said abutment part comprises a cap partially enclosing said outer end.

5. The apparatus of claim 1 wherein said valve stem includes an actuator portion that extends outwardly from said control duct into said interior chamber, said actuator portion including axial adjustment means for longitudinally adjusting the valve stem relative to said cam bar.

6. The apparatus of claim 5 wherein said cam bar includes a stem aperture and said actuator portion extends through said stem aperture and terminates at an implement engagement end which is accessible through said open cap end, said stem aperture having threads and said axial adjustment means comprising external threads about a predetermined section of said actuator portion for engagement with said stem aperture threads.

7. The apparatus of claim 1 wherein said valve seat means comprises a valve plate positioned adjacent to said control end wall; and, an end body located outward of said valve plate having an outlet duct in communication with said valve opening.

8. The apparatus of claim 1 including a lever arm secured to the lever end of said pivot plate, said lever arm having a free end which extends into an area proximate said handle portion whereby both the handle portion and lever arm can be manually grasped with one hand.

9. The apparatus of claim 8 wherein the actuator end of said pivot plate is connected to a pivot point on a respective lateral side wall of said valve portion, said cam portion being offset from said pivot point a distance sufficient to engage said cam abutment surface whereby rotational movement of said lever arm will result in an axial movement of said valve stem.

10. The apparatus of claim 1 wherein said valve stem terminal end portion includes a pivoted alignment head for self adjusted sealing engagement with said valve opening.

11. The apparatus of claim 1 wherein said feed duct intersects with said control duct at a feed control area proximate to said valve opening, said feed control area defined by the annular space between the terminal end portion of said valve stem and adjacent walls of said control duct.

12. The apparatus of claim 1 including:

a second control duct extending through said valve portion from said actuator end wall to said control end wall:

said valve seat means including a second valve opening in communication with said second control duct;

a second feed duct in said handle portion communicating with said control duct;

a second biasing adjustment opening extending through the outer wall of said stem housing; and, a second valve stem adjustably attached to said cam bar extending into said control duct, said valve stem having a terminal end portion adapted to sealingly engage the second valve opening of said valve seat means.

13. The apparatus of claim 12 including a second pivot plate having a lever end and a longitudinally spaced-apart actuator end pivotally connected to a side of said valve portion opposite the existing pivot plate, said actuator end including a respective cam portion which engages a respective cam abutment surface on the opposing end of said cam bar;

a tie bar interconnecting the lever ends of each pivot plate; and, a lever arm secured to said tie bar, said lever arm having a free end which extends into an area proximate said handle portion whereby both the handle portion and lever arm can be manually grasped with one hand.

14. The apparatus of claim 13 including an end body located adjacent said valve seat means having a second outlet duct in communication with said second valve opening.

15. The apparatus of claim 12 including a second biasing adjustment means connected to said stem housing to bias said second valve stem toward said second valve opening.

16. A hand-held manually operated fluid dispensing device which, when divided by a median plane, provides bilaterally symmetrical halves wherein each respective half comprises:

a valve portion having a lateral side wall extending between a control end wall and an opposing actuator end wall;

a control duct extending through said valve portion from said actuator end wall to said control end wall;

a handle portion connected to said valve portion having a feed duct communicating with said control duct;

a valve seat means connected to said control end wall having a valve opening with a center axis in alignment with the longitudinal axis of said control duct;

a stem housing comprising an outer wall with upper and lower walls extending from said outer wall to distal ends which abut said actuator end wall; said outer, upper and lower walls forming an interior chamber having a lateral side opening; said outer wall having a biasing adjustment opening extending therethrough with the center axis of said adjustment opening in alignment with the longitudinal axis of said control duct;

a cam bar with a stem aperture located within said chamber, said bar having a bar end which extends beyond said lateral side wall to provide a cam abutment surface;

a valve stem adjustably attached to said cam bar having a terminal end portion which extends into said control duct and sealingly engages the valve opening of said valve seat means; and, a pivot plate having a lever end and a longitudinally spaced-apart actuator end pivotally connected to said valve portion, said actuator end including a cam portion which engages the cam abutment surface on said cam bar to axially displace said cam bar when said actuator plate is rotated.

17. The device of claim 16 including a biasing adjustment means connected to said stem housing to bias said terminal end portion against said valve opening.

18. The device of claim 16 wherein said valve stem includes an actuator portion that extends outwardly from said control duct into said interior chamber, said actuator portion having axial adjustment means for longitudinally adjusting the valve stem relative to said cam bar.

19. The device of claim 16 including a lever arm secured to the lever end of said pivot plate, said lever arm having a free end which extends into an area proximate said handle portion whereby both the handle portion and lever arm can be manually grasped with one hand.

20. The device of claim 19 wherein the actuator end of said pivot plate is connected to a pivot point on a respective lateral side wall of said valve portion, said cam portion being offset from said pivot point a distance sufficient to engage said cam abutment surface whereby rotational movement of said lever arm will result in an axial movement of said valve stem.

* * * * *